United States Patent [19]

Miura et al.

[11] Patent Number: 4,531,980

[45] Date of Patent: Jul. 30, 1985

[54] CORROSION RESISTING COPPER ALLOY

[75] Inventors: Tatsuo Miura, Kariya; Kazuhiro Ohta, Nagoya; Yoshiharu Hasegawa, Ohbu; Takao Yoneyama, Kariya, all of Japan

[73] Assignee: Granges Metallverken AB, Västerås, Sweden

[21] Appl. No.: 546,074

[22] PCT Filed: Sep. 29, 1980

[86] PCT No.: PCT/EP80/00106

§ 371 Date: May 27, 1981

§ 102(e) Date: May 27, 1981

[87] PCT Pub. No.: WO81/00860

PCT Pub. Date: Apr. 2, 1981

Related U.S. Application Data

[63] Continuation-in-part of Ser. No. 269,027, May 27, 1981, abandoned.

[51] Int. Cl.[3] ..... C22F 1/08

[52] U.S. Cl. ..... 148/11.5 C; 148/13.2; 148/434; 165/DIG. 8

[58] Field of Search ..... 420/477, 472, 476; 148/413, 434, 11.5 C, 13.2; 165/DIG. 8

[56] References Cited

U.S. PATENT DOCUMENTS

| | | | |
|---|---|---|---|
| 2,131,437 | 9/1938 | Jennison . | |
| 2,224,095 | 12/1940 | Barry . | |
| 2,261,975 | 11/1941 | Crampton . | |
| 3,615,922 | 10/1971 | Alyea | 75/157.5 |

FOREIGN PATENT DOCUMENTS

| | | | |
|---|---|---|---|
| 543830 | 7/1957 | Canada | 148/11.5 C |
| 894529 | 12/1944 | France . | |
| 2249173 | 5/1975 | France . | |
| 4814 | 1/1979 | Japan | 420/472 |
| 102226 | 8/1979 | Japan | 75/157.5 |
| 123520 | 9/1979 | Japan | 148/11.5 C |
| 1285561 | 8/1972 | United Kingdom | 148/11.5 C |
| 1437056 | 5/1976 | United Kingdom | 75/157.5 |

OTHER PUBLICATIONS

Naether et al., "Structure and Softening of Brass During Accelerated Recrystallization", Metals Technology, Aug. 1980, pp. 345–347.

*Primary Examiner*—Peter K. Skiff
*Attorney, Agent, or Firm*—Spencer & Frank

[57] ABSTRACT

A corrosion resisting copper alloy, especially suitable for use in fabricating heat exchangers, comprises 25 to 38% by weight zinc, 0.005 to 0.04% by weight phosphorus, the remainder of the alloy being copper, the alloy having a recrystallized grain size within the range of 2μ to 10μ.

13 Claims, 10 Drawing Figures

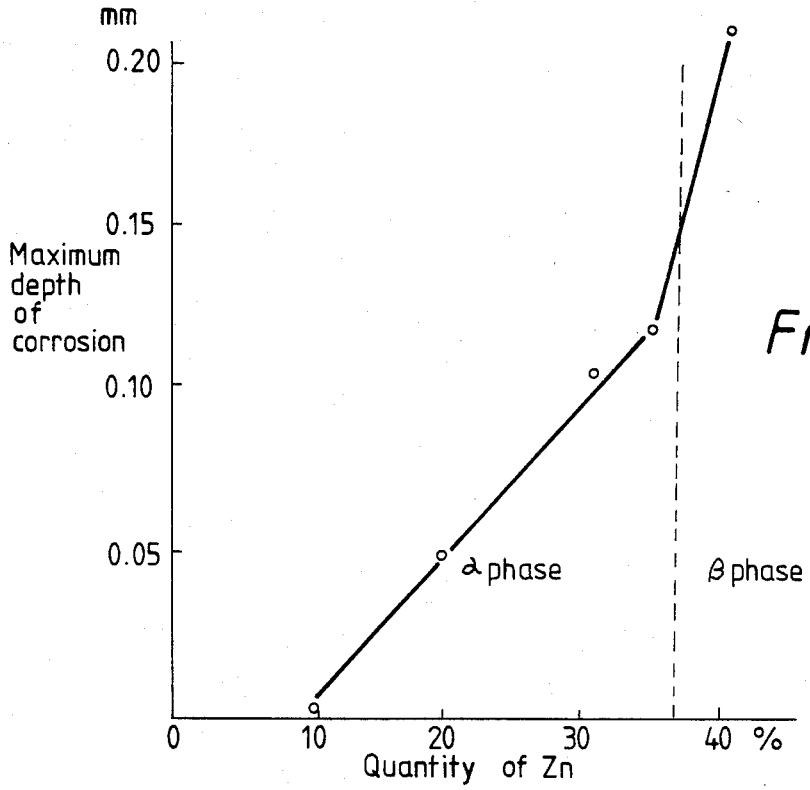
Fig.1
Fig.2
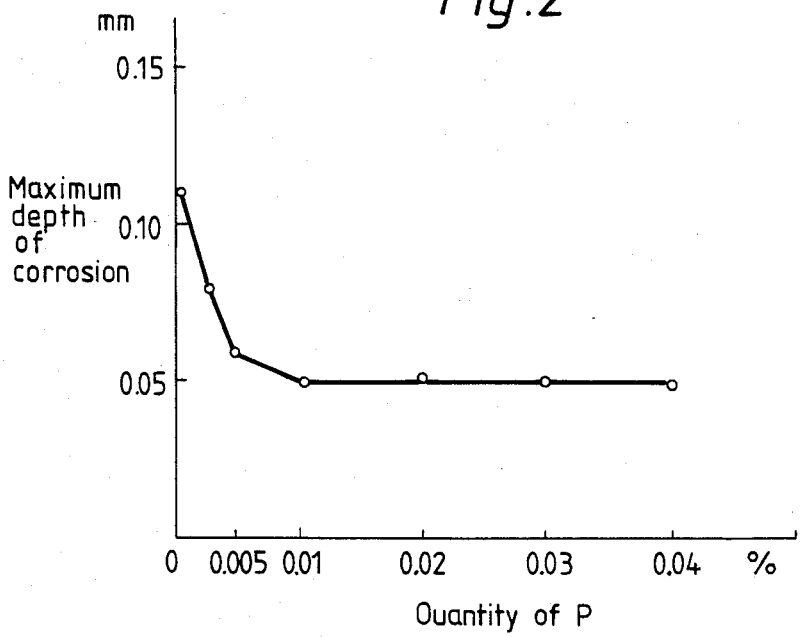

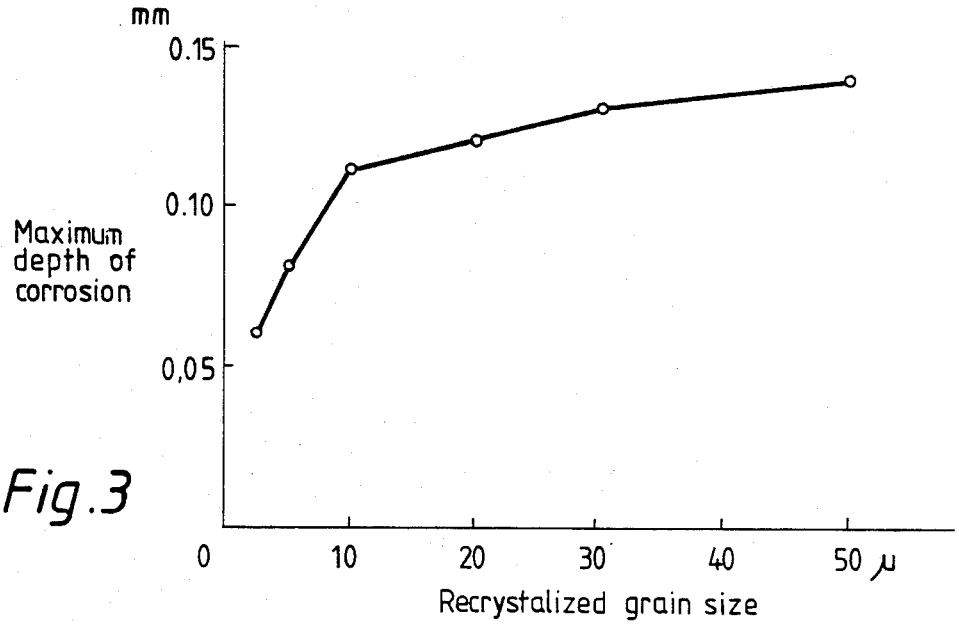
Fig.3
Fig.4
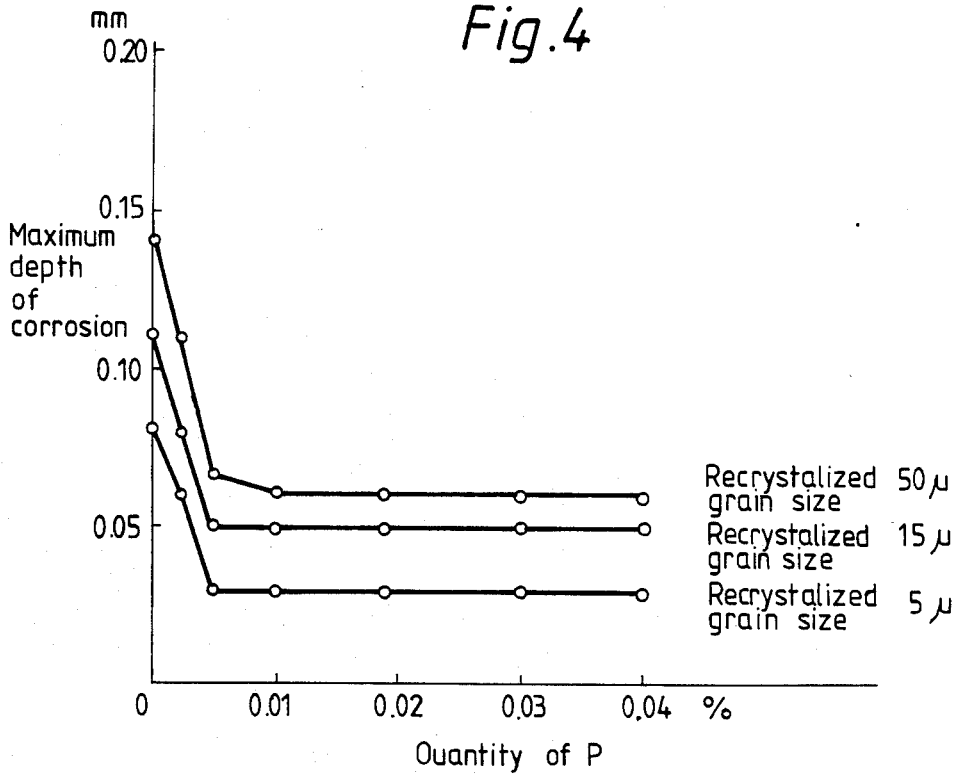

CORROSION RESISTING COPPER ALLOY

This is a continuation-in-part of application Ser. No. 269,027 filed May 27, 1981, now abandoned.

BACKGROUND OF THE INVENTION

The present invention relates to a corrosion resisting copper alloy and more particularly to a corrosion resistant copper alloy specially suitable for use with a heat exchanger and the invention also relates to heat exchangers using such an alloy. Such heat exchangers may be intended to be used under severe corrosive conditions and may, for example, be heat exchangers for heating cooling water for automobile engines or heat exchangers intended for industrial use.

In general, heat exchangers used for cooling water for use in connection with automobile engines, which are generally termed "radiators", are composed of a brass material which comprises 65 percent copper by weight and 35 percent zinc by weight. It is to be appreciated that when an automobile is in use the heat exchanger may be affected directly by harmful elements contained in exhaust gas emanating from the automobile, or other automobiles running on the same road, and also such a heat exchanger may be affected by salinity when the automobile is used near the sea shore, or when used on roads that have been treated with salt to prevent or minimize icing on the roads. Additionally the heat exchanger is always in contact with the heat exchanging medium circulating therein, and such a heat exchanging medium may be corrosive, particularly if the heat exchanging medium contains anti-freeze components. Thus heat exchangers of the type under the discussion are frequently used under severely corrosive conditions, with the heat exchanger being corrosively attacked both from the inside and from the outside.

A heat exchanger such as an automobile radiator operates by circulating a heat exchanging medium through a large number of tubes, and during the circulation of the heat exchanging medium heat is conducted to heat radiating fins which are in thermal contact with the tubes. Therefore, in order to ensure that there is sufficiently good heat conduction between the interior of the tubes and the fins it is preferred to make the tubes with walls that are as thin as possible. It is also preferable to make the heat exchanger as light as possible, again by making the walls of the tubes as thin as possible. Not only does this facilitate handling of the heat exchanger but also minimizes the amount of material used in making the heat exchanger, and this minimizes the costs of the materials utilized.

However, since a heat exchanger made of brass will corrode (by means of the so-called dezincifying corrosion) under the above mentioned severe corrosive conditions, there is a minimum practical thickness for the tube walls when the tubes are made of conventional brass and thus there is a minimum practical limit to the improvements of heat conductivity and the saving of material cost that can be effected by minimizing the thickness of the tube walls.

OBJECT OF THE INVENTION

The present invention seeks to provide a material which has a very high corrosion resistance whilst still having good thermal conductivity which will thus facilitate the manufacture of heat exchangers having tubes with thinner walls than heretofore. It is also an object of the invention to provide a method of making such a material. It is also an object of the invention to provide such a heat exchanger.

SUMMARY OF THE INVENTION

This invention provides a copper alloy exhibiting corrosion resisting properties which consists essentially of 25 to 38 percent zinc by weight of the alloy, 0.005 to 0.04 percent phosphorus by weight of said alloy, the balance of said alloy being copper, the recrystallized grain size of said alloy being within the range of $2\mu$ to $10\mu$ inclusive.

In an advantageous alloy in accordance with the invention the phosphorus is in a substantially uniform solid solution within the recrystallized grains of the alloy. This may be accomplished by recrystallizing the alloy at a temperature of between 450° and 600° C. for a period of time between 5 seconds and 5 minutes to produce grains of the required size.

This invention also provides a heat exchanger which comprises a plurality of tubes in which a heat exchanging medium may flow and which are composed of a copper alloy exhibiting corrosion resisting properties, said alloy consisting essentially of 25 to 38 percent zinc by weight of said alloy, 0.005 to 0.04 percent phosphorus by weight of said alloy, the balance of said alloy being copper, the recrystallized grain size of said alloy being within the range of $2\mu$ to $10\mu$ inclusive.

BRIEF DESCRIPTION OF THE DRAWINGS

In order that the invention may be more readily understood and so that further features thereof may be appreciated the invention will now be described by way of example with reference to the accompanying drawings in which:

FIG. 1 is a graphical figure illustrating the maximum depth of corrosion of various copper zinc alloys, not being alloys in accordance with the invention;

FIG. 2 is a graphical representation showing the maximum depth of corrosion in a copper zinc alloy relative to the quantity of phosphorus contained within the alloy;

FIG. 3 is a graphical representation illustrating the maximum depth of corrosion in a copper zinc alloy which does not contain phosphorus relative to the recrystallized grain size of the alloy;

FIG. 4 is a graphical figure showing the inter-relation between the maximum depth of corrosion of copper zinc alloys and the quantity of phosphorus contained in the alloy, showing the effect of specific recrystallized grain sizes when provided by a specific annealing technique;

DETAILED DESCRIPTION OF THE INVENTION

Figure 5:
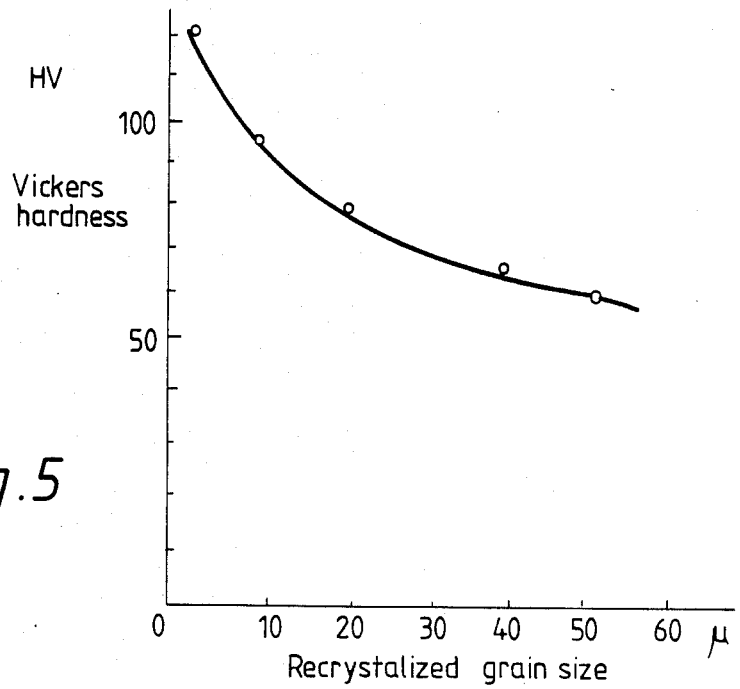
FIG. 5 is a graphical figure showing the relation between the recrystallized grain size and Vickers hardness of an alloy comprising only zinc and copper.

Referring now to the accompanying drawings, FIGS. 1 to 4 shows the results of corrosion tests conducted firstly with alloy materials which comprise merely copper and zinc and secondly with alloy materials which comprise copper, zinc and phosphorus. The tests were carried out for 30 days consecutively according to the JISZ 2371 salt water spray testing method. In each case the alloy material used in the test was of rectangular shape having a length of 100 mm, a width of 20 mm and a thickness of 0.5 mm. The salt water used in these tests was a 5% by weight NaCl solution at 35° C. The maximum depth of corrosion shown in each of FIGS. 1 to 4 shows the deepest corrosion of the corroded parts relative to the original surface of the alloy material.

Initially considering FIG. 1, it is to be noted that the alloy material subject to the test does not contain phosphorus, but has a recrystallized grain size of 10μ. The relation of the maximum depth of corrosion is plotted relative to the quantity of zinc contained within the alloy. It can be seen from FIG. 1 that the greater the quantity of zinc, the deeper the corrosion depth becomes, and after the quantity of zinc exceeds 38% in the alloy the so-called β phase is educed in large quantities, with the result of lower corrosion resistivity and lower cold-workability of the material. On the other hand, whilst the corrosion is least with the smallest quantity of zinc, the higher quantity of copper that must be used in such an alloy brings about a higher manufacturing cost and the excellent characteristics peculiar to brass are lost. Therefore experience has shown that the quantity of zinc present in the alloy should not be lower than 25% by weight, and thus it can be seen that it is most desirable for the quantity of zinc within the alloy to be within the range of 25% by weight to 38% by weight, and the optimum compromise between cost and corrosion resistance is found in the range of 25% to 30% by weight.

FIG. 2 illustrates the relationship between the quantity of phosphorus contained within the alloy and the maximum depth of corrosion, the maximum depth of corrosion being plotted against the percentage by weight of phosphorus. In FIG. 2 the quantity of zinc in the alloy is maintained at a constant 35% by weight, but it will be appreciated that the quantity of copper varies inversely with the quantity of phosphorus. The recrystallized grain size of the samples tested to form the graph of FIG. 2 was set at 10μ.

From FIG. 2 it can be seen that the corrosion resisting effect of the material varies over a relatively wide range with the maximum depth of corrosion falling rapidly from a maximum when no phosphorus is present until a phosphorus content of approximately 0.005% by weight is reached, the corrosion resistance then falling less rapidly. It is to be noted that after a phosphorus content of 0.01% by weight has been reached the addition of further phosphorus does not significantly alter the maximum depth of corrosion. It has been found that the increase in the quantity of phosphorus above 0.01% by weight does slightly increase the resistivity to corrosion but if the quantity of phosphorus exceeds 0.04% by weight, grain boundary corrosion is liable to occur at the crystal grain boundaries which constitute the alloy. Thus it is preferred that, in the alloy in accordance with the invention, the quantity of phosphorus is within the range of 0.005% by weight to 0.04% by weight, and most preferably within the range of 0.01% to 0.04% by weight.

FIG. 3 is a further graphical figure illustrating the relation between the recrystallized grain size of the alloy and the maximum depth of corrosion. In this figure the material tested did not contain any phosphorus and is thus not a material in accordance with the invention. The material comprises merely 35% by weight zinc and 65% by weight copper.

Figure 9:
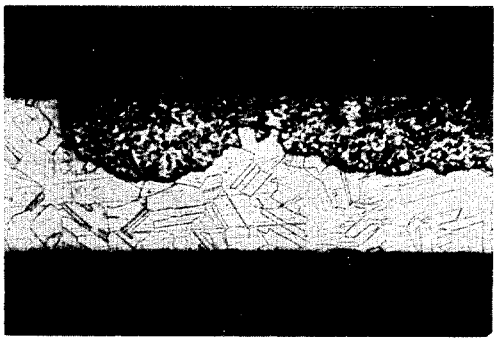
FIG. 9 is a micro photograph showing plug dezincification corrosion of an alloy.
Figure 10:
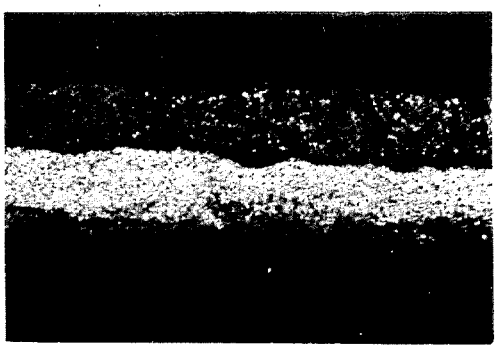
FIG. 10 is a micro photograph showing laminar dezincification corrosion of an alloy.

From FIG. 3 it can be seen that, in general, the smaller the recrystallized grain size, the less the depth of maximum corrosion. Thus is a consequence of the mechanism of dezincification corrosion which will be explained below in more detail. In connection with the corrosion of brass by dezincification it has been known that two types of dezincification, termed plug dezincification and laminar dezincification, may occur. FIGS. 9 and 10 are, respectively, microphotographs of sections cut through elements of brass alloys that have been corroded by these two types of dezincification. FIG. 9 illustrates an element that has been corroded by plug dezincification, and as can be seen from FIG. 9 the corrosion progresses unevenly and tends to form pin holes through the corroded element. Corrosion of this type is most undesirable in connection with the tubes of a heat exchanger, since such corrosion can rapidly result in water leakage. On the other hand, in laminar corrosion, the material corrodes evenly, and there is not the same tendency to form pin holes. Thus, whilst clearly it would be preferred that if dezincification is to occur the dezincification should be laminar dezincification, no specific way has previously been proposed to make the brass dezincify in a laminar manner rather than in a plug manner.

However, the present applicants, after the microscopic examination of many corroded elements, and appropriate experimentation have now determined that by making the recrystallized grain size of the alloy very fine, the form of dezincification can be changed gradually from plug corrosion to laminar corrosion, with the consequent result that the maximum depth of corrosion can be minimized if an optimum recrystallized grain size is used. Thus, the finer the recrystallized grain size, the better the alloy, but it has also been found that if the recrystallized grain size is selected to be less than 2μ recrystallization is often not completed by the final heat treatment and the initial processed construction of the alloy remains since all the alloy is not recrystallized, with a resultant lowering of corrosion restivity. Thus it is thought proper that lowest limit of the recrystallized grain size should be 2μ.

FIG. 4 further illustrates the retain between the quantity of phosphorus contained in the alloy and the recrystallized grain size of the material on the maximum depth of corrosion. It is to be noted that in FIG. 4 the quantity of zinc contained within the various alloys tested is a constant 35% by weight, but the quantity of copper varies inversely with the quantity of phosphorus. FIG. 4 shows that in the case where the recrystallized grain size of the material is constant, there is only a very little advantage to be obtained by adding more than 0.01% of phosphorus to the material. However FIG. 4 does make it clear that the maximum depth of corrosion is reduced with finer recrystallized grain sizes. As can be seen most clearly in FIG. 8, which should be read in conjunction with Table 2 as explained below, the most advantageous material can be obtained when the alloy includes a quantity of phosphorus between 0.005 and 0.04% by weight and when the alloy has recrystallized grains of a size less than 10μ, prepared by an appropriate annealing process. Thus, it is to be noted that the upper boundary of the recrystallized grain size should be 10μ, but most preferably the recrystallized grain size should be within the range of 3μ to 6μ.

FIG. 5 is a graphical representation showing the relation between the recrystallized grain size and the Vickers hardness of an alloy material. The alloy material in question is composed of 35% by weight and 65% copper by weight. As can be readily appreciated from FIG. 5 the smaller the recrystallized grain size the better the hardness of the material.

It is to be noted that the recrystallized grain size of an alloy in accordance with the present invention can be adjusted by adjusting the annealing conditions, that is to say the temperature of the annealing process and the time of the annealing process of the alloy material.

An alloy containing the components of an alloy in accordance with the invention is preferably annealed at a high temperature for a short period of time. To enable this to be done the alloy must first be prepared in the form of elements that have a small or thin cross section to enable the whole of the element to be heated up rapidly to the required temperature, and then be cooled again. Typically the elements are thin strips of alloy, less than 0.25 mm in thickness. The strips may have a thickness of 0.1 mm and may even be as thin as 0.08 mm. The thin strips are of significant length, and are fed through a furnace. The portion of the strip within the furnace at any instant is heated, and due to the thinness of the strip and the good thermal conductivity of the alloy the entire portion of the strip within the furnace is heated. The temperature within the furnace is selected so that the strip is heated to a temperature within the range of 450° to 600° C., preferably approximately 550°. The size of the furnace and the speed of advance of the strip is so selected that any point on the strip will be subjected to the annealing conditions for a period of time of between 5 seconds and 5 minutes. Preferably the annealing time is approximately 30 seconds. Thus the strip is annealed at a very high temperature for a very short period of time. The strip may subsequently be force cooled by means of a cold air blast, or by being passed through a tank of an appropriate coolant.

An alloy annealed by this technique has small grains, and it is believed that the use of a high temperature for a short period of time enables the phosphorus to be maintained in a substantially uniform solid solution during the annealing step. In contrast it is believed that when annealing is carried out at a lower temperature for a longer period of time, whilst small grain sizes may be obtained, the phosphorus does not remain in a uniform solid solution within the grains but tends to migrate to the border regions of the grains. This concentration of phosphorus of the grain boundaries tends to another type of corrosion, namely intercrystalline corrosion. This type of corrosion can be just as damaging as dezincification.

It is to be noted that the use of a high annealing temperature is usually associated with large grain sizes, since the grains tend to grow when at high temperatures. See, for samples 3 to 7 of Table 1 below which illustrate this trend. However, in the described technique the alloy is only annealed for a very short period of time and thus the grain sizes do not exceed the desired limits.

Figure 6:
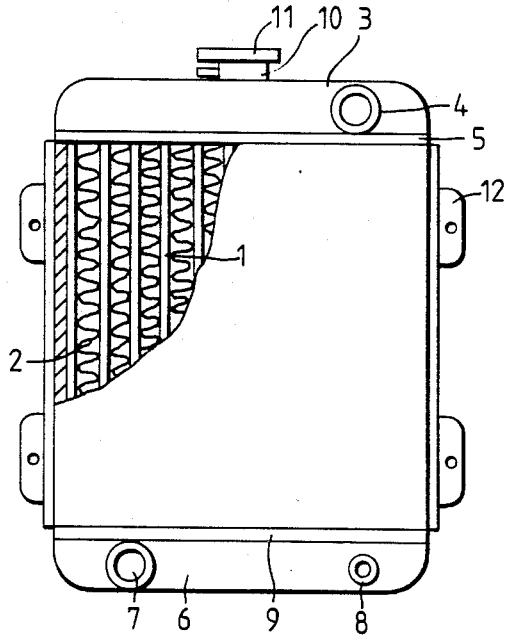
FIG. 6 is a front view, partially cut away showing one embodiment of a heat exchanger in accordance with the present invention.

FIG. 6 illustrates, by way of example, a heat exchanger made from an alloy material in accordance with the present invention. The heat exchanger comprises a number of parallel tubes 1 which are associated with a heat radiating metal fin 2. The tubes are made from the above described alloy in accordance with the present invention. The tubes are arranged in spaced parallelism between a header tank 3, which has an associated inlet pipe 4, and which has a core plate 5 which connects the tank to the tubes 1. The tubes are also connected to a sump tank 6 which has an outlet 7, and which also has a drain plug 8. The sump tank 6 is connected to the tubes 1 by means of a core plate 9 which corresponds with the core plate 5. The header tank 3 is provided with a filler spout 10 which is provided with a cap 11. The radiator assembly is provided with fixing brackets 12.

It is to be appreciated that the general construction of the radiator is conventional, but the material utilized for forming the tubes 1 is novel. The header and sump tanks 3 and 6 and the associated inlet and outlet pipes 4 and 7 may be made of brass, but may alternatively be made of thermosetting resin. It is to be appreciated that since the tanks and the inlet and outlet pipes have no relation to the thermal radiation capabilities of the heat exchanger they can be of any desired thickness to resist corrosion, and thus it is preferred that the tanks and the pipes be made from pure brass from the point of view of minimizing cost. However the alloy of the present invention may, if desired, be utilizing to form the tanks and the inlet and outlet pipes.

It is to be appreciated that the fin 2 is preferably made of copper, but fins other than those having the wavy form shown in FIG. 6 may be utilizing. Thus, for example, plate-like fins may be used. When using such plate-like fins they may be fitted mechanically to the tube 1 by locating the tube through apertures in the plate-like fins and expanding the outside diameter of the tube by utilizing a conventional tube expanding method. This method is also applicable to the fitting of the tube 1 to the core plates 5 and 9. It is to be appreciated that the various elements of the illustrated heat exchanger may, where appropriate, be connected to each other by means of soldering, as is conventional.

The present invention is described further below with reference to specific examples.

Ingots (22 mm thick×150 mm wide×200 mm long) each of different composition as shown in Table 1 were produced by melting copper at a high temperature, covering the surface of molten copper with charcoal powder in order to prevent oxidation, adding approximate quantities of zinc and phosphorus thereto to form the appropriate alloy, and casting the resultant alloy into a metal mold. Each of the resultant ingots were scalped, subjected to repeated cycle and intermediary annealing, and then made into 0.5 mm thick plates. The plates were then annealed at a temperature and for a duration as shown in Table 1 to adjust the recrystallized grain size. The plates for examples 24 to 26 were 0.25 mm thick for the annealing step to adjust the grain size.

The plates were then cut to form elements having a size of 100 mm in length, 20 mm in width and 0.5 mm in thickness to produce elements of the alloy for testing purposes. (0.25 mm thickness for examples 24 to 26). Each of these elements were subjected to the salt water spray test utilizing 5% by weight NaCl solution at 35° according to JISZ 2371, and subsequently, after the period of 30 days, the depth of corrosion of each sample was measured.

Each of the sample alloys was utilizing to form a respective core portion of a heat exchanger such as that shown in FIG. 6, each core portion comprising the tubes 1 and the fins 2. In each case the core portion had an overall length, in the axial direction of the tubes 1, of 150 mm, a width of 70 mm and a thickness of 32 mm. The core included two rows, each row containing 5 tubes, and thus the overall tube length in the core portion was 1500 mm. These core portions were each then subjected to a salt water spray test for 8 consecutive days and the number of corrosion holes, including corrosion holes that fully penetrate the tube and those corrosion holes that partially penetrate the tube was determined.

With regard to the soldering properties, the surface of a sample element of each of alloys 1 to 23 having a thickness of 0.5 mm a width of 5 mm and a length of 50 mm was cleaned. The element was then dropped in a bath of molten solder comprising 20% by weight tin and 80% by weight lead minimized at a temperature of 300° C. The element was left for 10 seconds immersed at a depth of 2 mm in the bath and the maximum adhesion force, the force required to pull the material from the solder bath, at that time was measured.

The recrystallized grain sizes shown in Table 1 were obtained by comparison with a standard photograph according to JISH 0501.

TABLE 1

| Sample No. | Composition of alloy (%) (rest Cu) Zn | P | Annealing condition Temp (°C.) time = 30 min) | Recrystallized grain size (μ) | Soldering property (mg wt) | Depth of Corrosion (μ) after 30 day salt water test | No. of holes (pcs./after after 8 day the salt water spray |
|---|---|---|---|---|---|---|---|
| 1 | 24 | 0.019 | 400 × 30 | 5 | 300 | 27 | 2 |
| 2 | 25 | " | " | 5 | 305 | 28 | 2 |
| 3 | 27 | " | 350 × 30 | 3 | 300 | 30 | 2 |
| 4 | 27 | " | 400 × 30 | 7 | 310 | 31 | 2 |
| 5 | 27 | " | 420 × 30 | 9 | 305 | 33 | 2 |
| 6 | 27 | " | 450 × 30 | 10 | 320 | 34 | 2 |
| 7 | 27 | " | 500 × 30 | 19 | 310 | 50 | 6 |
| 8 | 29 | " | 400 × 30 | 7 | 310 | 30 | 2 |
| 9 | 30 | " | " | 5 | 305 | 31 | 2 |
| 10 | 33 | 0.016 | " | 6 | 300 | 30 | 2 |
| 11 | 35 | 0.001 | " | 5 | 310 | 75 | 15 |
| 12 | 35 | 0.0025 | " | 7 | 305 | 60 | 10 |
| 13 | 35 | 0.005 | " | 6 | 305 | 32 | 2 |
| 14 | 35 | 0.011 | " | 6 | 300 | 30 | 2 |
| 15 | 35 | 0.019 | " | 6 | 305 | 32 | 2 |
| 16 | 35 | 0.025 | " | 5 | 305 | 31 | 2 |
| 17 | 35 | 0.04 | " | 6 | 310 | 30 | 2 |
| 18 | 35 | — | " | 5 | 315 | 80 | 20 |
| 19 | 35 | — | 500 × 30 | 20 | 305 | 120 | 11 |
| 20 | 36 | 0.017 | 400 × 30 | 5 | 310 | 33 | 2 |
| 21 | 37 | 0.019 | " | 5 | 315 | 34 | 3 |
| 22 | 38 | 0.019 | " | 5 | 310 | 50 | 7 |
| 23 | 40 | 0.019 | " | 5 | 305 | 150 | 30 |
| 24 | 30 | 0.015 | 550 × 0.5 | 5 | — | 27 | 2 |
| 25 | 30 | 0.015 | 600 × 0.5 | 15 | — | 52 | 6 |
| 26 | 30 | <.001 | 550 × 0.5 | 6 | — | 125 | 29 |

As can be seen from the above Table 1 certain alloys according to the invention, listed as alloys 2 to 6, 8 to 10, 13 to 17 and 20 to 22 have soldering properties which are equivalent with the soldering properties of conventional brass as exemplified by alloys 18 to 19, whilst the alloys in accordance with the invention exhibit corrosion properties such that the salt water spray test only corroded the alloy to a very slight depth. Thus it will be appreciated that examples of alloys in accordance with the present invention have excellent corrosion resisting properties. On the other hand, alloys which have a composition similar to that of the present invention but which have recrystallized grains of a larger size than 10μ for example comparative alloy No. 7, exhibit deep corrosion after being subjected to the salt spray test. Comparative alloys which contain only a very small quantity of phosphorus for example the comparative alloys specified as sample No. 11 and that specified as sample No. 12 have inferior corrosion resistance properties. It is to be noted that the comparative alloy, shown as sample No. 23, which contains a large quantity of zinc, exhibits inferior corrosion resistive properties.

As can be seen from Table 1 when core-portions made from alloys in accordance with the invention were subjected to the 8 day salt water spray test, the tubes exhibited a fewer number of corrosion holes than the number of corrosion holes exhibited by corresponding core portions fabricated from conventional alloys. It is to be noted that the alloy itemized as sample No. 1 in Table 1, which is outside the scope of the present invention, does show fewer corrosion holes, but it is to be noted that this alloy contains a large quantity of copper and it is thus very expensive.

Alloy 24 is a preferred alloy according to the invention since any tendency to intercrystalline corrosion is minimized. This type of corrosion can only be demonstrated by tests that take several months to complete. Alloy 25 shows the result of annealing at too high a temperature for too long, i.e. an over-large grain size with a resultant loss of the excellent corrosion resistant properties of an alloy according to the invention. Alloy 26 does not have the quantity of phosphorus required for an alloy in accordance with the invention, and thus has poor corrosion resisting properties.

Figure 7:
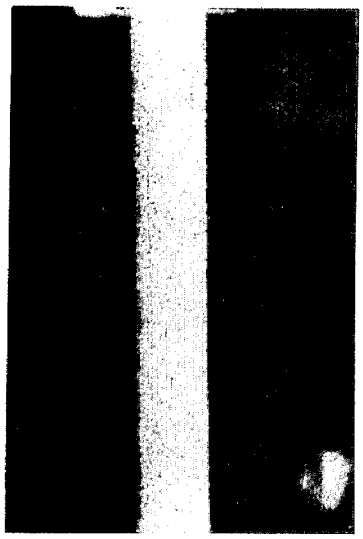
FIG. 7 is a photo-micrograph showing a cross section of an element mode of an alloy in accordance with the present invention.

FIG. 7 is a photomicrograph (100 magnifications) showing a cross section of material corresponding to alloy 15, that is to say a material in accordance with the present invention.

Subsequent investigations were made into the progress of the number of corrosion holes according to the number of days of salt water spray testing, and again core portions fabricated as described above were utilized. Table 2 shows the composition of the five alloys that were subjected to this investigation, and FIG. 8 shows the results of the investigation.

TABLE 2

| Symbol | Composition of alloy % P | Zn | Cu | Recrystallized grain size | Remark |
|---|---|---|---|---|---|
| △ | 0 | 35 | rest | 15 | Comparative Alloy |
| ○ | 0 | " | " | 3 | " |
| ▲ | 0.021 | " | " | 8 | Alloy of the present invention |
| ● | 0.021 | " | " | 3 | Alloy of the present invention |
| ■ | 0.011 | " | " | 3 | Alloy of the present invention |

Figure 8:
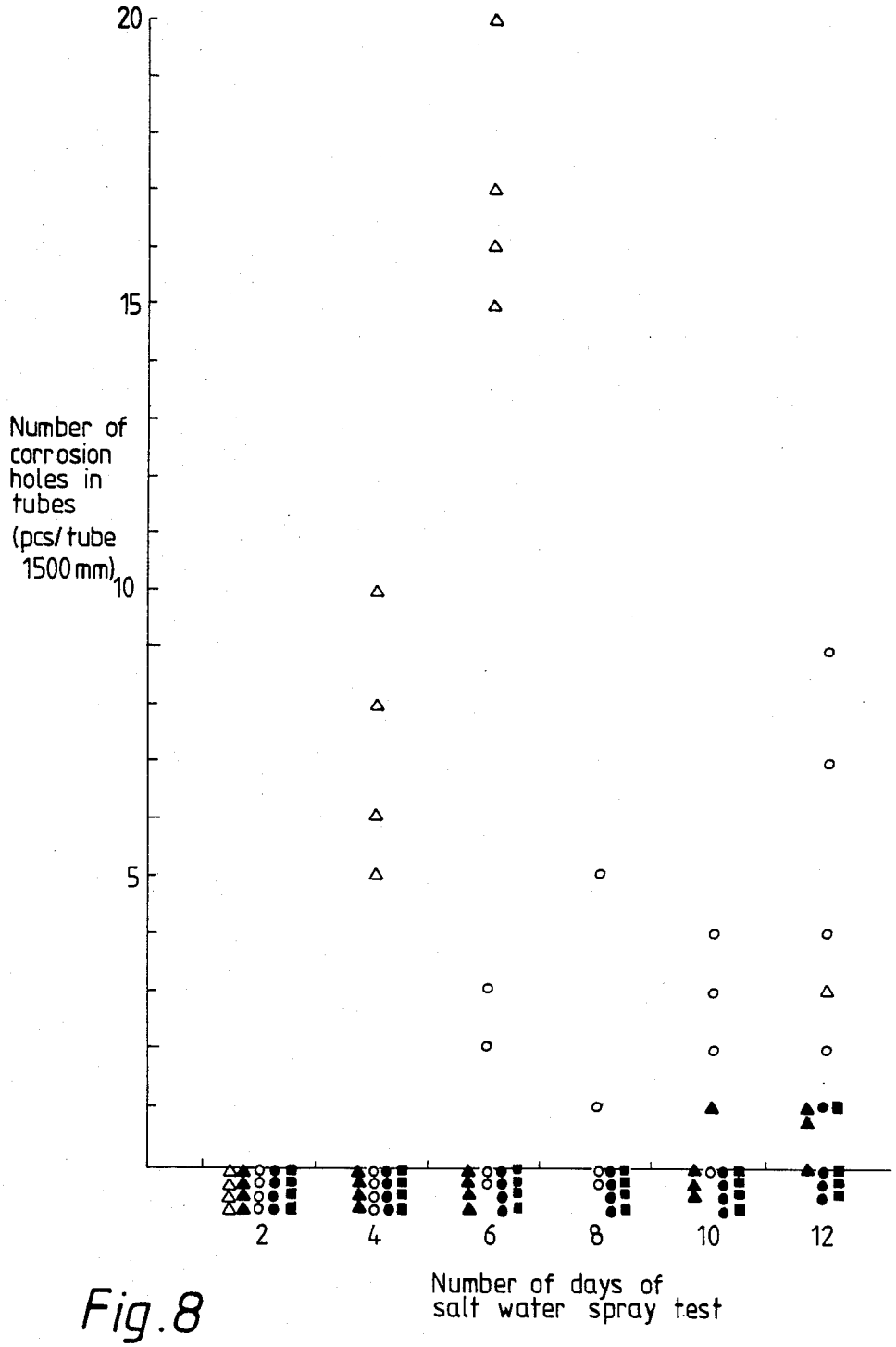
FIG. 8 is a graphical diagram illustrating the number of corrosion holes formed in heat exchangers in accordance with the present invention and in conventional prior proposed heat exchangers.

As can be seen from FIG. 8, in each case four samples of each of the 5 alloys were utilized, and thus 20 samples were utilized in all. It can be seen that after 2 days of spraying all 20 samples showed no signs of corrosion. After 4 days of spraying all four samples of an alloy having recrystallized grains of a relatively large size showed signs of corrosion. After 6 days the corrosion of these four samples was substantial, and also a second alloy, which does not contain any phosphorus, was also showing signs of corrosion. As the test proceeded the alloys having large grain sizes and having no phosphorus showed maximum corrosion, whereas alloys in accordance with the present invention showed minimum corrosion and indeed, of the 12 samples of alloys in accordance with the invention tested, after 12 days seven samples showed no signs of corrosion.

From the foregoing paragraphs it will be appreciated that the present invention provides a copper alloy which displays excellent corrosion resistivity even when exposed to severely corrosive conditions. Also, by utilizing a copper alloy in accordance with the present invention as a material for the tubes of a heat exchanger, the present invention makes it possible to utilize tubes having relatively thin walls for a heat exchanger with a resultant improvement of heat conductivity and with the important advantage that the heat exchanger is of light weight, and thus utilizes a minimum amount of material and can consequently be fabricated at a relatively low cost. However, the thinness of the walls of the tubes made of copper alloy in accordance with the invention does not reduce the strength of the tubes or the corrosion resistivity of the tubes, as a result of the fine recrystallized grain size of the alloy.

We claim:

1. A method of producing a copper alloy exhibiting corrosion resisting properties, said alloy consisting essentially of 25 to 38 percent zinc by weight of the alloy, 0.005 to 0.04 percent phosphorus by weight of said alloy, the balance of said alloy being copper, comprising the steps of preparing said alloy in the form of an element having a small cross-section to permit rapid heating thereof;

heating said alloy to a temperature of between 450 and 600 degrees for a period of time between 5 seconds and 5 minutes to recrystallize grain size and maintain the phosphorus in a substantially uniform solid solution; and cooling said alloy, said alloy being recrystallized with a grain size of between 2 and 10 microns and having a depth of corrosion after a 30 day salt water test which is not greater than 34 microns.

2. A method according to claim 1, wherein said temperature is approximately 550° C.

3. A method according to claim 1, wherein said time is approximately 30 seconds.

4. A method according to claim 1 wherein the alloy is annealed in the form of a strip having a thickness of less than 0.25 mm.

5. A method according to claim 2, wherein said time is approximately 30 seconds.

6. A heat exchanger which comprises a plurality of tubes in which a heat exchanging medium may flow and which are composed of a copper alloy exhibiting corrosion resisting properties, said alloy consisting essentially of 25 to 38 percent zinc by weight of said alloy, 0.005% to 0.04 percent phosphorus by weight of said alloy, the balance of said alloy being copper, the recrystallized grain size of said alloy being within the range of 2μ to 10μ inclusive, the phosphorus being in a substantially uniform solid solution within the grain of the alloy and the alloy having a depth of corrosion after a 30 day salt water test which is not greater than 34μ.

7. A heat exchanger according to claim 6, wherein the amount of phosphorus in said alloy is within the range 0.01% to 0.04% by weight of said alloy.

8. A heat exchanger according to claim 6, wherein said recrystallized grain size is within the range 3μ to 6μ.

9. A heat exchanger according to claim 7, wherein said recrystallized grain size is within the range 3μ to 6μ.

10. A heat exchanger which comprises a plurality of tubes in which a heat exchanging medium may flow and which are composed of a copper alloy exhibiting corrosion resisting properties, said alloy consisting essentially of 25 to 38 percent zinc by weight of said alloy, 0.005% to 0.04 percent phosphorus by weight of said alloy, the balance of said alloy being copper, the recrystallized grain size of said alloy being within the range of 2μ to 10μ inclusive, the phosphorus being in a substantially uniform solid solution within the grain of the alloy, the alloy having been recrystallized by having been heated to a temperature of between 450° and 600° C. for a period of time between 5 seconds and five minutes, and having a depth of corrosion after a 30 day salt water test which is not greater than 34μ.

11. A heat exchanger according to claim 10, wherein the amount of phosphorus in said alloy is within the range 0.01% to 0.04% by weight of said alloy.

12. A heat exchanger according to claim 10, wherein said recrystallized grain size is within the range 3μ to 6μ.

13. A heat exchanger according to claim 11, wherein said recrystallized grain size is within the range 3μ to 6μ.

* * * * *